US011415924B2

(12) United States Patent
Yamada

(10) Patent No.: US 11,415,924 B2
(45) Date of Patent: Aug. 16, 2022

(54) SORTING DEVICE AND IMAGE FORMING APPARATUS THEREWITH

(71) Applicant: KYOCERA Document Solutions Inc., Osaka (JP)

(72) Inventor: Tomoyasu Yamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/386,813

(22) Filed: Jul. 28, 2021

(65) Prior Publication Data

US 2022/0035295 A1 Feb. 3, 2022

(30) Foreign Application Priority Data

Aug. 3, 2020 (JP) ..... JP2020-131381

(51) Int. Cl.
*B65H 29/60* (2006.01)
*G03G 15/00* (2006.01)

(52) U.S. Cl.
CPC ..... *G03G 15/6538* (2013.01); *B65H 29/60* (2013.01)

(58) Field of Classification Search
CPC ..... B65H 2405/351
See application file for complete search history.

(56) References Cited

U.S. PATENT DOCUMENTS

2002/0158405 A1* 10/2002 Nagasako ..... B65H 31/10 271/220
2008/0186522 A1* 8/2008 Tsuji ..... B65H 31/02 358/1.12
2015/0239702 A1* 8/2015 Sugiyama ..... B65H 33/08 271/220
2019/0366746 A1* 12/2019 Emoto ..... B65H 43/00

FOREIGN PATENT DOCUMENTS

JP 2001-31317 A 2/2001
JP 2005-132546 A 5/2005

* cited by examiner

*Primary Examiner* — Jennifer Bahls
(74) *Attorney, Agent, or Firm* — Stein IP, LLC

(57) ABSTRACT

A sorting device includes a base portion, a tray portion, and a tray driving portion. The tray driving portion includes a motor, a supporting shaft, an input member, an output member, a link mechanism, and an urging member. The input member includes a first boss portion movably supported on the supporting shaft, and is reciprocatable up and down along the supporting shaft. The output member has a second boss portion coupled with the first boss portion via a ratchet mechanism. The link mechanism converts a rotary motion of the output member to a linear motion of the tray portion. The ratchet mechanism operates such that, when a predetermined or heavier load is applied to the output member via the tray portion, the input member is pushed down against the urging force of the urging member and engagement between the first and second ratchet teeth is released.

6 Claims, 7 Drawing Sheets

SORTING DEVICE AND IMAGE FORMING APPARATUS THEREWITH

INCORPORATION BY REFERENCE

This application is based upon and claims the benefit of priority from the corresponding Japanese Patent Application No. 2020-131381 filed on Aug. 3, 2020, the entire contents of which are hereby incorporated by reference.

BACKGROUND

The present disclosure relates to a sorting device which sorts sheets by moving a tray on which the sheets are stacked, and to an image forming apparatus provided with such a sorting device.

Conventionally, sheet postprocessing devices are used which can perform postprocessing such as: binding, in which a plurality of sheets on which images have been formed by an image forming apparatus such as a copier or a printer are stacked and the stacked sheet bundle is bound with staples; punch hole formation, in which punch holes are made by a punch hole forming device and sorting, in which bundles of sheets are sorted.

SUMMARY

A sorting device according to one aspect of the present disclosure includes a base portion, a tray portion, and a tray driving portion, and performs sorting of a sheet bundle by arranging the tray portion at two or more sorting positions by moving the tray portion in the sheet width direction with respect to the base portion. The tray portion is supported on the base portion and is reciprocatable in the sheet width direction perpendicular to the sheet discharging direction. The tray driving portion configured to reciprocate the tray portion in the sheet width direction. The tray driving portion includes a motor, a supporting shaft, an input member, an output member, and a link mechanism. The supporting shaft is supported on the base portion. The input member has a gear portion to which the driving force of the motor is transmitted and a first boss portion which has formed in it a shaft hole in which the supporting shaft is inserted. The input member rotates about the supporting shaft with the rotation driving force of the motor. The output member has a second boss portion coupled with the top end of the first boss portion on the input member via a ratchet mechanism and configured to output the rotation driving force to the tray portion. A link mechanism configured to convert the rotary motion of the output member to the linear motion of the tray portion along the sheet width direction. The input member is reciprocatable in the up-down direction along the supporting shaft. The ratchet mechanism includes a first ratchet tooth, a second ratchet tooth, and an urging member. The first ratchet tooth is provided at the upper end edge of the first boss portion on the input member. The second ratchet tooth is provided at the lower end edge of the second boss portion on the output member to engage with the first ratchet tooth. The urging member urges the input member in a direction approaching the output member. The ratchet mechanism operates such that, when a predetermined or heavier load is applied to the output member via the tray portion, the input member is pushed down against the urging force of the urging member and engagement between the first and second ratchet teeth is released.

DETAILED DESCRIPTION

Figure 1:
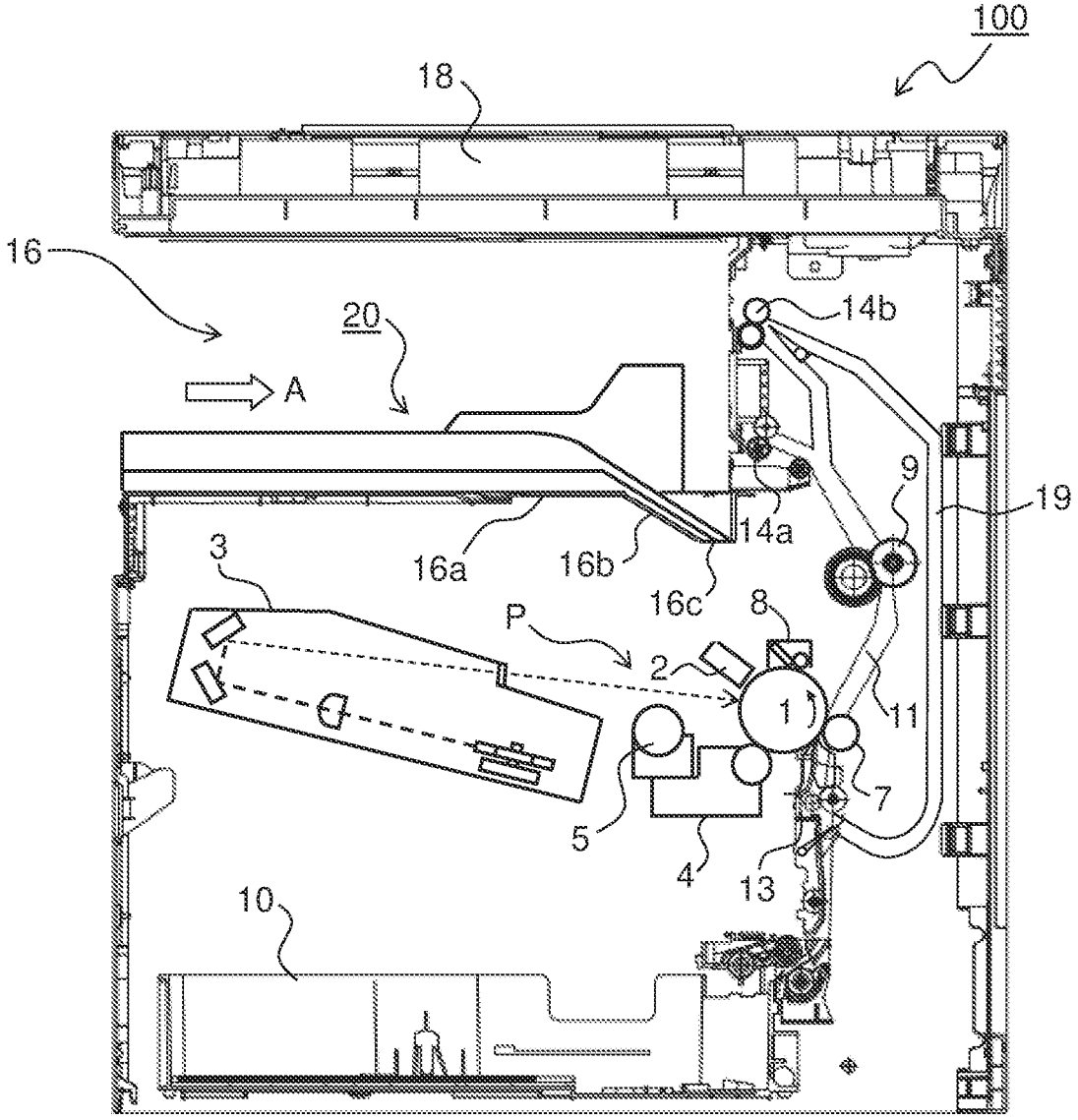
FIG. 1 is a schematic diagram showing an internal configuration of an image forming apparatus mounted with a sorting device according to the present disclosure.

Hereinafter, with reference to the accompanying drawings, an embodiment of the present disclosure will be described. FIG. 1 is a schematic diagram showing the internal structure of an image forming apparatus 100 and a sorting device 20 according to the present disclosure. Although this embodiment deals with a multifunction peripheral as one example of the image forming apparatus 100, the sorting device 20 according to the present disclosure can be similarly coupled also with any image forming apparatuses other than a digital multifunction peripheral such as a laser printer, an inkjet printer, and a facsimile machine.

As shown in FIG. 1, inside the main body of the image forming apparatus (e.g., a monochrome multifunction peripheral) 100, there is disposed an image forming portion P that forms a monochrome image through the processes of charging, exposure, development, and transfer.

In the image forming portion P, there are disposed, along the rotating direction of a photosensitive drum 1 (in the counter-clockwise direction in FIG. 1), a charging portion 2, an exposure unit 3, a developing device 4, a transfer roller 7, a cleaning device 8, and a static eliminator (unillustrated). The image forming portion P, while rotating the photosensitive drum 1 in the counter-clockwise direction in FIG. 1, performs an image forming process with respect to the photosensitive drum 1.

The photosensitive drum 1 is, for example, an aluminum drum coated with a photosensitive layer, and its surface can be electrically charged by the charging portion 2. As the surface is irradiated with a laser beam from the exposure unit 3, which will be described later, the electric charge is so attenuated as to form an electrostatic latent image.

The charging portion 2 serves to electrically charge the surface of the photosensitive drum 1 uniformly. Used as the charging portion 2 is, for example, a corona discharge device which causes electric discharge by application of a high voltage to a thin piece of wire acting as an electrode. The exposure unit 3 irradiates the photosensitive drum 1 with a light beam (for example, a laser beam) based on document image data read in an image reading portion 18, and thereby forms an electrostatic latent image on the surface of the photosensitive drum 1.

The developing device 4 serves to form a toner image by attaching toner to the electrostatic latent image on the photosensitive drum 1. The toner is fed to the developing device 4 from a toner container 5.

The transfer roller 7 transfers the toner image formed on the surface of the photosensitive drum 1 to sheet conveyed through a sheet conveying passage 11. The cleaning device 8 is provided with a cleaning roller, a cleaning blade, or the like that makes line contact with the photosensitive drum 1 in its longitudinal direction, and removes unused toner on the surface of the photosensitive drum 1 after the transfer of the toner image to the sheet.

The image reading portion 18 includes a scanning optical system, which includes a scanner lamp that illuminates a document during copying and a mirror that changes the optical path of the reflected light from the document, a condenser lens that converges the reflected light from the document and forms an image, a CCD sensor that converts the focused image light to an electrical signal (none of these are illustrated), and reads a document image and converts it to image data.

When copy operation is performed, document image data is converted to a read image signal in the image reading portion 18. On the other hand, in the image forming portion P, the charging portion 2 electrostatically charges the photosensitive drum 1 uniformly which rotates in the counterclockwise direction in the diagram. Then, the exposure unit 3 irradiates the photosensitive drum 1 with a laser beam (ray of light) based on image data read by the image reading portion 18, and thereby forms an electrostatic latent image based on the image data on the surface of the photosensitive drum 1. Thereafter, the developing device 4 attaches toner to the electrostatic latent image to form a toner image.

Toward the image forming portion P, where the toner image has now been formed as described above, a sheet is conveyed from a sheet storage portion 10 with predetermined timing through a sheet conveying passage 11 via a registration roller pair 13. Then, in the image forming portion P, the toner image formed on the surface of the photosensitive drum 1 is transferred to a sheet by the transfer roller 7. Then, the sheet having the toner image transferred to it is separated from the photosensitive drum 1, and is conveyed to a fixing portion 9, where, under application of heat and pressure, the toner image is fixed to the sheet.

The sheet that has passed through the fixing portion 9 is conveyed, through the sheet conveying passage 11, to a pair of discharge rollers 14*a* or 14*b*. When an image is formed only on one side of a sheet, the sheet is discharged by the pair of discharge rollers 14*a* to the sorting device 20 that is mounted in a sheet discharge space 16.

On the other hand, when images are formed on both sides of a sheet, the tip end of the sheet that has passed through the fixing portion 9 is momentarily stuck out into the sheet discharge space 16 through the pair of discharge rollers 14*b*. Then, the pair of discharge rollers 14*b* is rotated backward, and thereby the sheet is switched back to be directed to a reversing conveying passage 19, and is conveyed again to the registration roller pair 13 with the image face reversed. Then, the next image formed on the surface of the photosensitive drum 1 is transferred to the face of the sheet on which no image has yet been formed by the transfer roller 7. Then, the sheet is conveyed to the fixing portion 9 to have the toner image fixed to it, and is then discharged to the sorting device 20 by the pair of discharge rollers 14*a*.

The sorting device 20 is removably mounted on a bottom portion 16*a* of the sheet discharge space 16. The sorting device 20 performs sorting by moving, in units of a predetermined number of sheets, the sheets discharged from the pair of discharge rollers 14*a* alternately in the sheet width direction (the direction perpendicular to the plane of FIG. 1) perpendicular to the discharging direction. When the sorting device 20 is removed from the sheet discharge space 16, the bottom portion 16*a* is used as a sheet discharge tray.

The bottom portion 16*a* has an inclined face 16*b* and a depressed portion 16*c*. The inclined face 16*b* is formed downstream of the bottom portion 16*a* with respect to the insertion direction (arrow A direction) of the sorting device 20, and is inclined upward from the upstream side to the downstream side in the sheet discharging direction (from right to left in FIG. 1). The sheets discharged by the pair of discharge rollers 14*a* to the bottom portion 16*a* slide down along the inclined face 16*b* upstream in the discharging direction, and are thereby stacked with their trailing edges aligned. The depressed portion 16*c* is formed downstream of the inclined face 16*b* with respect to the insertion direction.

Figure 2:
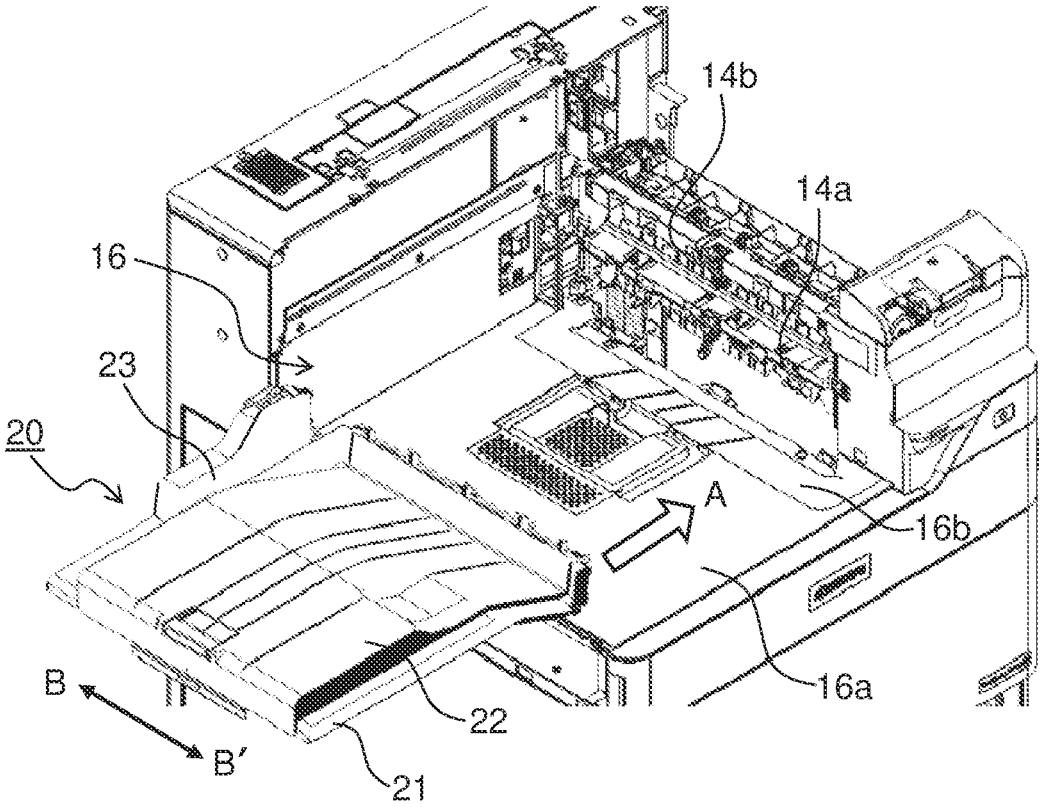
FIG. 2 is a perspective view showing how the sorting device is mounted in a sheet discharge space in the image forming apparatus as seen from above.
Figure 3:
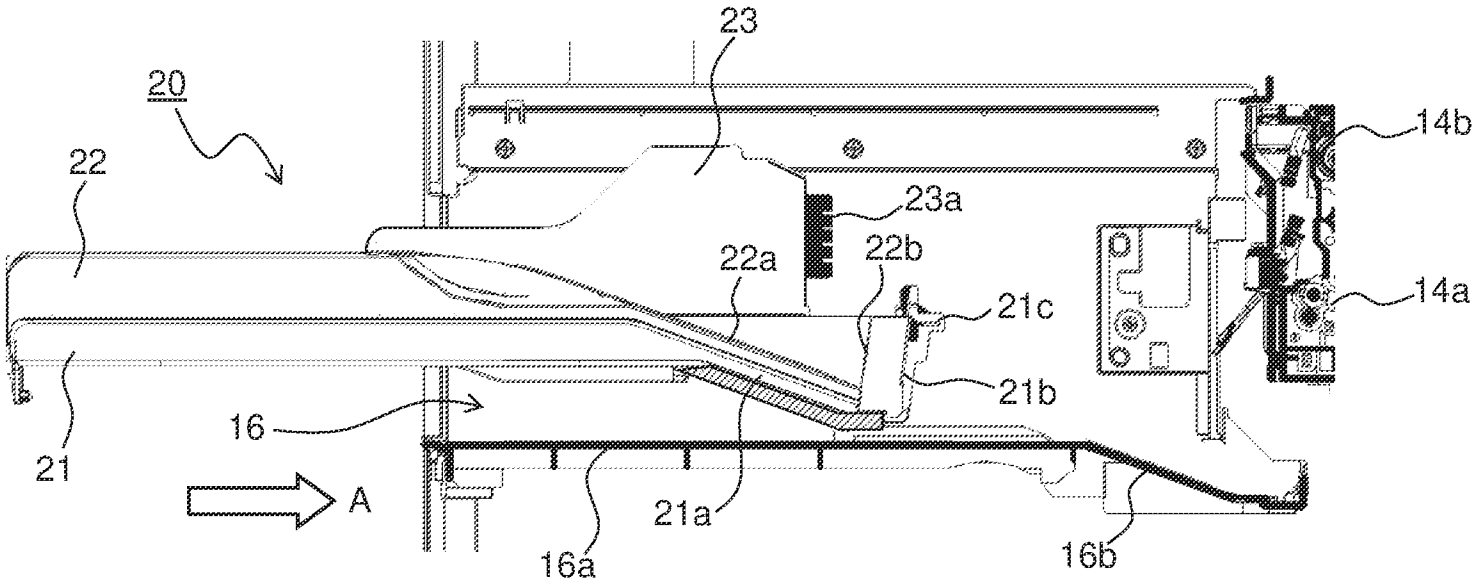
FIG. 3 is a side view showing how the sorting device is mounted in the sheet discharge space as seen from in front of the image forming apparatus.
Figure 4:
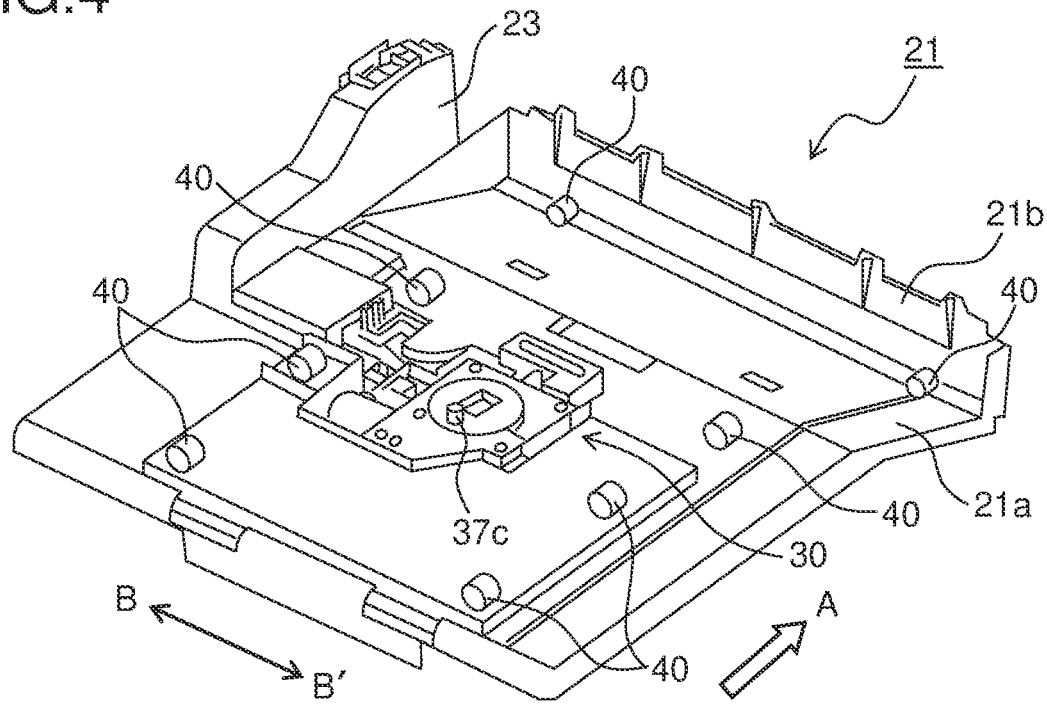
FIG. 4 is a perspective view of a base portion of the sorting device as seen from above.
Figure 5:
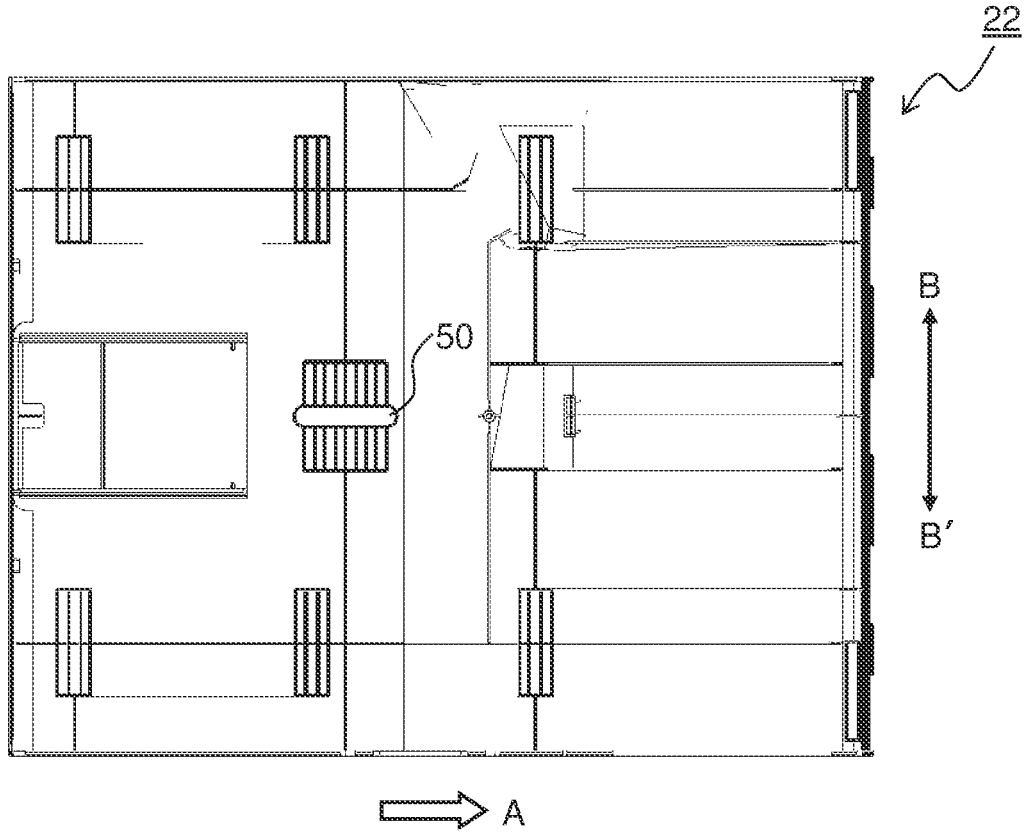
FIG. 5 is a plan view of a tray portion of the sorting device as seen from beneath.

FIG. 2 is a perspective view showing how the sorting device 20 is mounted in the sheet discharge space 16 as seen from above. FIG. 3 is a side view showing how the sorting device 20 is mounted in the sheet discharge space 16 as seen from in front of the image forming apparatus 100. FIG. 4 is a perspective view of a base portion 21 of the sorting device 20 as seen from above. FIG. 5 is a plan view of a tray portion 22 of the sorting device 20 as seen from beneath. The sorting device 20 includes the base portion 21 and the tray portion 22.

The base portion 21 is fixed to the bottom portion 16*a* of the sheet discharge space 16. The base portion 21 is in a bent shape substantially identical with the bottom portion 16*a* of the sheet discharge space 16 as seen in a side view, and has a first inclined portion 21*a* and a first rear wall portion 21*b*. With the base portion 21 fixed to the bottom portion 16*a*, the first inclined portion 21*a* faces the inclined face 16*b* and, similarly to the inclined face 16*b*, inclines upward toward the downstream side in the sheet discharging direction. The first rear wall portion 21*b* rises from a lower end part of the first inclined portion 21*a* and faces a second rear wall portion 22*b* of the tray portion 22. On the first rear wall portion 21*b*, an engaging portion 21*c* is formed which engages with an engaged portion (unillustrated) provided under the pair of discharge rollers 14*a*.

In an end part of the base portion 21 on the far side with respect to the sheet width direction (on the rear side of the image forming apparatus 100, in the arrow B direction), a connecting portion 23 is provided upright. The connecting portion 23 includes a connector 23*a* to which a cable for transmitting electric power and control signals to the sorting device 20 is connected.

As shown in FIG. 4, substantially in a central part of the base portion 21, a tray driving portion 30 for making the tray portion 22 reciprocate in the sheet width direction is disposed. The structure of the tray driving portion 30 will be described in detail later.

At a plurality of (here, eight) places on the top face of the base portion 21, slide rollers 40 are disposed. The slide rollers 40 each have a rotary shaft disposed parallel to the sheet discharging direction and rotates in the sheet width direction (arrow BB' direction). The base portion 21 and the tray portion 22 make contact with each other via the slide rollers 40, so that the tray portion 22 reciprocates smoothly in the sheet width direction with respect to the base portion 21.

The tray portion 22 is supported on the top face of the base portion 21 so as to be reciprocatable in the sheet width direction (arrow BB' direction), and sheets discharged from the pair of discharge rollers 14*a* are stacked on it. The tray portion 22 has a second inclined portion 22*a* and the second rear wall portion 22*b*. The second inclined portion 22*a* faces the first inclined portion 21*a* of the base portion 21 and, similarly to the first inclined portion 21*a*, inclines upward toward the downstream side in the discharging direction. The second rear wall portion 22*b* rises from a lower end part of the second inclined portion 22*a* and aligns the trailing edges of the sheets that have slid down along the second inclined portion 22*a*.

As shown in FIG. 5, substantially in a central part of the back surface of the tray portion 22, a guide groove 50 in an oval shape is formed. The guide groove 50 extends along the sheet discharging direction (from right to left in FIG. 5), and a convex portion 37*c* (see FIG. 6) of an output member 37 in the tray driving portion 30 engages with the guide groove 50. The movement of the tray portion 22 in the direction (the left-right direction in FIG. 5) parallel to the sheet discharging direction is restricted.

When sorting is performed by the sorting device 20, with the tray portion 22 disposed at one side (for example, in the arrow B direction) in the sheet width direction with respect to the base portion 21, sheets are discharged through the pair of discharge rollers 14*a* onto the tray portion 22. The sheets discharged on the tray portion 22 slide down along the inclined portion of the tray portion 22 upstream in the discharging direction, and their trailing edges are aligned by the second rear wall portion 22*b*. When a prescribed predetermined number of sheets have been discharged, the tray portion 22 is moved to the other side (in the arrow B' direction) in the sheet width direction.

Then, when another predetermined number of sheets have been discharged, the tray portion 22 is moved back to the one side (in the arrow B direction) in the sheet width direction. As such operation is repeated, bundles of sheets are stacked on the tray portion 22, in a form sorted in the sheet width direction in units of a predetermined number of sheets.

Figure 6:
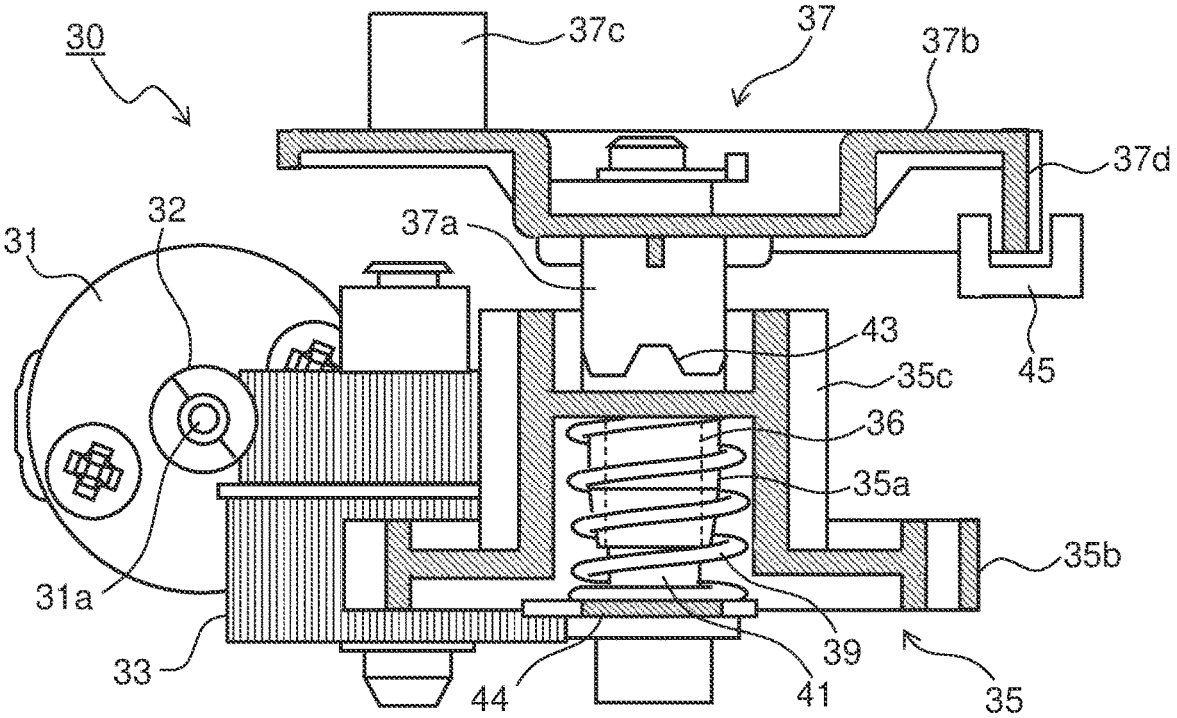
FIG. 6 is a vertical sectional view of an input member and an output member that constitute a tray driving portion, illustrating a state where the tray portion is operating normally.

FIG. 6 is a vertical sectional view of an input member 35 and the output member 37 that constitute the tray driving portion 30. The tray driving portion 30 includes a motor 31, an idle gear 33, the input member 35, the output member 37, and a sliding pin 41 (supporting shaft).

To a rotary shaft 31*a* of the motor 31, a pinion gear (worm gear) 32 is fixed. The idle gear 33 is a two-stage gear having a small-diameter portion and a large-diameter portion, and the pinion gear 32 engages with the small-diameter portion of the idle gear 33.

The input member 35 has a first boss portion 35*a*, a gear portion 35*b*, and an outside boss portion 35*c*. In the first boss portion 35*a*, there is formed a shaft hole 36 in which the sliding pin 41 supported on the bottom face of the base portion 21 is inserted. At the upper end edge of the first boss portion 35*a* (the opening edge of the shaft hole 36), a first ratchet tooth 43*a* (see FIG. 7) is formed. The gear portion 35*b* is formed on a circle centered around the first boss portion 35*a* and engages with the large-diameter portion of the idle gear 33. The outside boss portion 35*c* rises in a cylindrical shape from the top face of the gear portion 35*b* so as to surround the first boss portion 35*a*.

The output member 37 has a second boss portion 37*a* and a flange portion 37*b*. The second boss portion 37*a* is coupled with the first boss portion 35*a* on the input member 35. The flange portion 37*b* is formed in a shape of a disk centered around the second boss portion 37*a*, and the convex portion 37*c* in a cylindrical shape is formed at a position displaced from the second boss portion 37*a* in the radial direction. At the lower end edge of the second boss portion 37*a*, a second ratchet tooth 43*b* (see FIG. 7) is formed, and the second boss portion 37*a* is coupled with the first boss portion 35*a* by a ratchet mechanism 43.

The tray driving portion 30 is structured as a unit which has integrated in it the motor 31, the idle gear 33, the input member 35, the output member 37, and the sliding pin 41, and the tray driving portion 30 is built by mounting this unit on the base portion 21. The tray driving portion 30 may be built by mounting those individual members separately on the base portion 21.

When the output member 37 is rotated with the convex portion 37*c* fitted in the guide groove 50 (see FIG. 5) in the tray portion 22, the convex portion 37*c* moves around a circular orbit. As the convex portion 37*c* moves around, also the tray portion 22, which is fitted in the convex portion 37*c* via the guide groove 50, tends to makes a circular movement, but the movement of the tray portion 22 in the direction parallel to the sheet discharging direction is restricted. As a result, the tray portion 22, following the round movement of the convex portion 37*c*, reciprocates in the sheet width direction (arrow BB' direction) in which the tray portion 22 is movable. The convex portion 37*c* and the guide groove 51) are one example of a link mechanism which converts the rotary motion of the output member 37 into the linear motion of the of the tray portion 22 along the sheet width direction.

In a part of the outer circumferential edge of the flange portion 37*b*, a light shielding portion 37*d* is formed, and a position sensor 45 (detecting portion) is disposed so as to be optically interrupted by the light shielding portion 37*d* when the tray portion 22 is arranged at a predetermined sorting position. The position detection sensor 45 is a PI (photointerruptor) sensor including a light emitting portion and a light receiving portion, and it detects the position of the convex portion 37*c* by detecting whether the light shielding portion 37*d* transmits or intercepts light along the optical path between the light emitting portion and the light receiving portion. It is thus possible to detect that the tray portion 22 is disposed at a predetermined sorting position.

Figure 7:
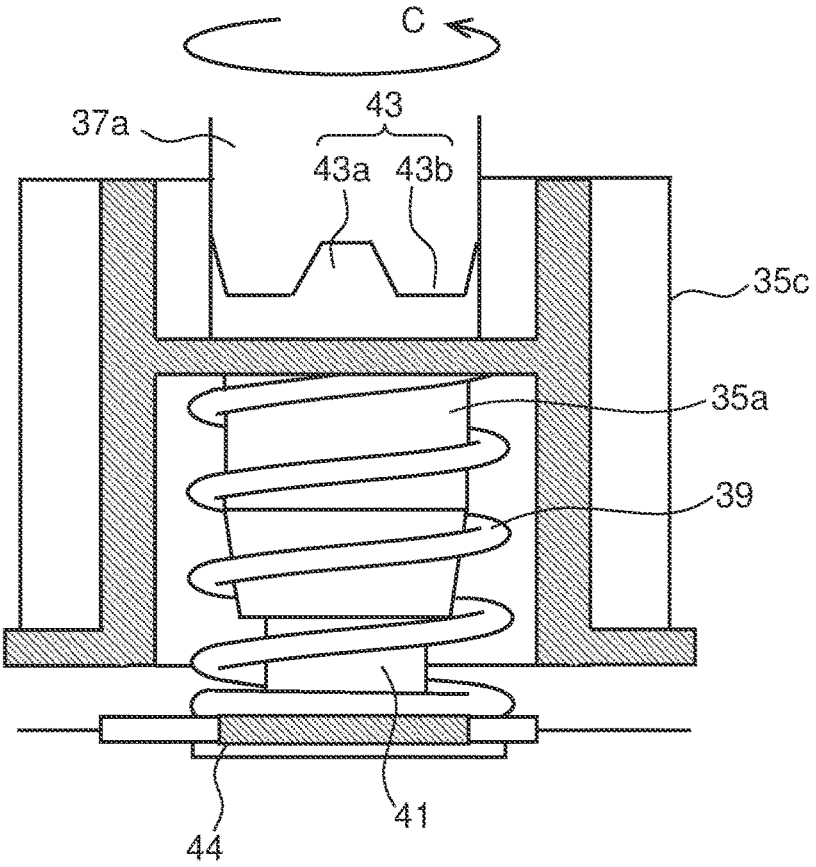
FIG. 7 is an enlarged view of and around a coupling portion between the input member and the output member in FIG. 6.

FIG. 7 is an enlarged view of and around a coupling portion between the input member 35 and the output member 37 in FIG. 6. The ratchet mechanism 43 includes the first ratchet tooth 43*a* in a trapezoid shape formed at the top end of the first boss portion 35*a*, the second ratchet tooth 43*b* in an inverted trapezoid shape formed at the lower end of the second boss portion 37*a*, and a compression coil spring 39 (urging member).

The compression coil spring 39 is, at a lower end part of it, supported on a spring supporting plate 44. In the spring supporting plate 44, a U-shaped cut-off part is formed through which the sliding pin 41 passes through the spring supporting plate 44. That is, the compression coil spring 39 is disposed between the spring supporting plate 44 and the input member 35, and is fitted around the sliding pin 41 and the first boss portion 35*a*. The compression coil spring 39 urges the input member 35 in such a direction (upward in FIG. 6) that the first boss portion 35*a* on the input member 35 engages with the second boss portion 37*a* on the output member 37.

Figure 8:
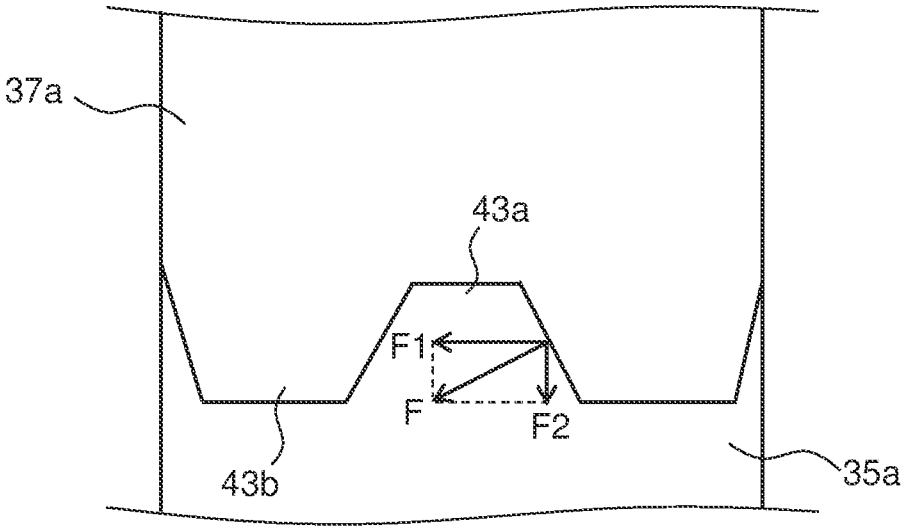
FIG. 8 is a diagram showing a drag acting from a second ratchet tooth on a first ratchet tooth.

FIG. 8 is a diagram showing the drag that acts from the second ratchet tooth 43*b* on the first ratchet tooth 43*a*. When the input member 35 rotates in the arrow C direction in FIG. 7, also the first boss portion 35*a* rotates in the arrow C direction, and the rotation driving force is transmitted from the first ratchet tooth 43*a* to the second ratchet tooth 43*b*. As a reaction to the rotation driving force, a drag F acts from the second ratchet tooth 43*b* on the first ratchet tooth 43*a*.

The drag F acts perpendicularly with respect to the engagement face between the first and second ratchet teeth 43*a* and 43*b*. The drag F is divided into a horizontal component force F1 that acts in the direction opposite to the rotation direction of the first boss portion 35*a* and a vertical component force F2 that acts in the direction to press the first boss portion 35*a*.

FIGS. 6 and 7 show a state where the tray portion 22 is operating normally, and no excessive load is applied to the tray portion 22. In this state, the component force F2 is smaller than the urging force of the compression coil spring 39, and thus the first and second ratchet teeth 43*a* and 43*b* engage with each other completely, so that a rotation driving force is transmitted from the first boss portion 35*a* to the second boss portion 37*a*.

Figure 9:
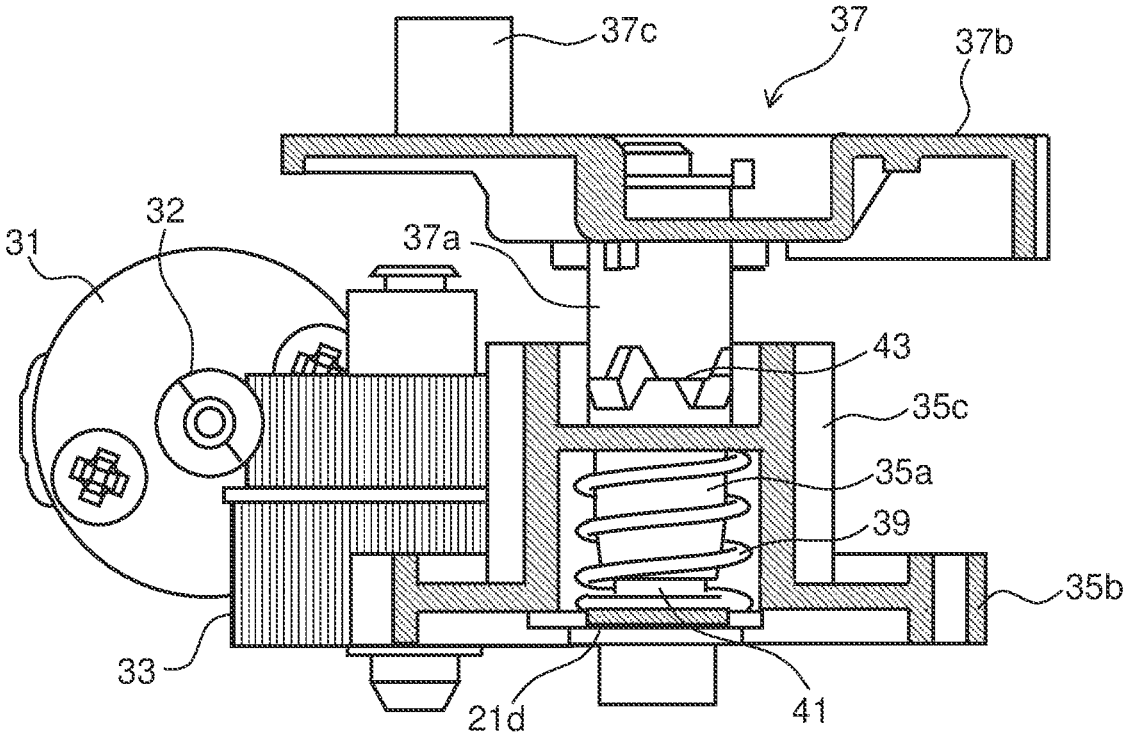
FIG. 9 is a vertical sectional view of the input member and the output member that constitute the tray driving portion, illustrating a state where a predetermined or heavier load is applied to the tray portion.
Figure 10:
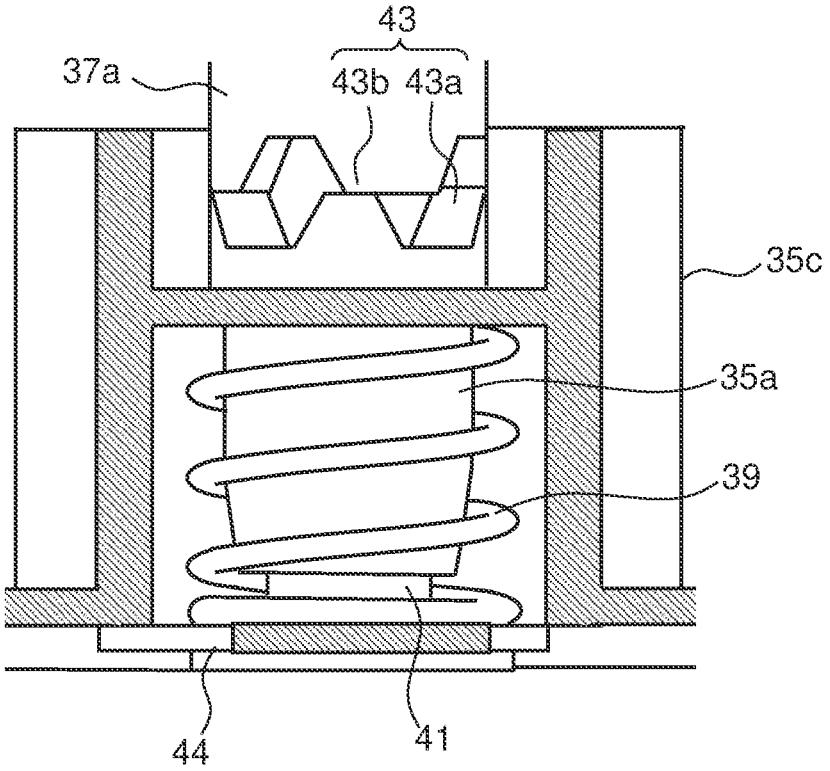
FIG. 10 is an enlarged view of and around the coupling portion between the input member and the output member in FIG. 9.

FIG. 9 is a vertical sectional view of the input member 35 and the output member 37 that constitute the tray driving portion 30, illustrating a state where a predetermined or heavier load is applied to the tray portion 22. FIG. 10 is an enlarged view of and around the coupling portion between the input member 35 and the output member 37 in FIG. 9. When a predetermined or heavier load is applied to the tray portion 22, a drag F larger than usual acts from the second ratchet tooth 43*b* on the first ratchet tooth 43*a*.

Here, if the vertical component force F2 of the drag F becomes greater than the urging force of the compression coil spring 39, the compression coil spring 39 is compressed to lower the first boss portion 35*a*. As a result, as shown in FIGS. 9 and 10, the second ratchet tooth 43*b* runs on the first ratchet tooth 43*a*, and engagement between the first and second ratchet teeth 43*a* and 43*b* is released. As a result, transmission of the rotation driving force from the input member 35 to the output member 37 ceases, and the tray portion 22 stops moving.

With a structure according to this embodiment, a driving force is transmitted from the input member 35 to the output member 37 using the ratchet mechanism 43, and thus, when a predetermined or heavier load is applied to the tray portion 22, engagement between the ratchet mechanism 43 is released and transmission of the driving force ceases. This makes it possible to prevent the tray driving portion 30 from breaking. In addition, the risk of user injuries can be eliminated.

When the vertical component force F2 of the drag F that acts from the second ratchet tooth 43*b* on the first ratchet tooth 43*a* in the ratchet mechanism 43 becomes greater than the urging force of the compression coil spring 39, engagement between the first and second ratchet teeth 43*a* and 43*b* is released. Thus, by adjusting the spring constant of the compression coil spring 39, it is possible to freely set the load over which transmission of the rotation driving force ceases.

The embodiment described above is in no way meant to limit the present disclosure, which thus allows for many modifications and variations within the spirit of the present disclosure. For example, although the above embodiments deal with an example where sorting is performed by moving the tray portion 22 by the tray driving portion 30 between two sorting positions: at one side (the arrow B direction) and the other side (arrow W direction) in the sheet width direction, it is also possible to perform sorting by moving the tray portion 22 among three or more sorting positions.

Although the above embodiment deals with an example where the present disclosure is applied to a sorting device 20 disposed in a sheet discharge space 16 in an image forming apparatus 100, it is applicable similarly to sorting devices mounted on a sheet postprocessing device that is coupled with an image forming apparatus 100.

The present disclosure is applicable to sorting devices which sort sheets by moving a tray for stacking the sheets. Based on the present disclosure, it is possible to provide a sorting device which can prevent a driving portion from breaking when a load is applied to the tray and which can ensure user safety as well, and to provide an image forming apparatus provided with such a developing device.

What is claimed is:

1. A sorting device comprising:

a base portion;

a tray portion supported on the base portion and capable of reciprocating in a sheet width direction perpendicular to a sheet discharging direction; and a tray driving portion configured to reciprocate the tray portion in the sheet width direction, wherein the tray portion is moved in the sheet width direction with respect to the base portion to be disposed at two or more sorting positions to sort a sheet bundle, the tray driving portion includes:

a motor;

a supporting shaft supported on the base portion;

an input member having a gear portion to which a driving force of the motor is transmitted, and a first boss portion in which a shaft hole is formed in which the supporting shaft is inserted, the input member rotating about the supporting shaft with a rotation driving force of the motor;

an output member having a second boss portion coupled with a top end of the first boss portion on the input member via a ratchet mechanism, and configured to output the rotation driving force to the tray portion; and a link mechanism configured to convert a rotary motion of the output member to a linear motion of the tray portion along the sheet width direction, the input member being reciprocatable in an up-down direction along the supporting shaft, the ratchet mechanism includes:

a first ratchet tooth which is provided at an upper end edge of the first boss portion on the input member;

a second ratchet tooth which is provided at a lower end edge of the second boss portion on the output member to engage with the first ratchet tooth; and an urging member which urges the input gear in a direction approaching the output member, and the ratchet mechanism operates such that, when a predetermined or heavier load is applied to the output member via the tray portion, the input member is pushed down against an urging force of the urging member and engagement between the first and second ratchet teeth is released.

2. The sorting device according to claim 1,
wherein
in a ratchet mechanism, when, of a drag that acts from the output member on an engagement face between the first and second ratchet teeth, a component force which acts vertically downward is greater than the urging force of the urging member, transmission of the rotation driving force by the ratchet mechanism ceases.

3. The sorting device according to claim 1,
wherein
the supporting shaft is a sliding pin, and
the urging member is a compression coil spring which is disposed between a spring supporting plate through which the sliding pin passes and the input member and which is externally fitted around the sliding pin and the first boss portion.

4. The sorting device according to claim 1,
wherein
the output member includes
a flange portion in a circular shape which rotates about the second boss portion, and
a convex portion which is formed on a top face of the flange portion, at a position shifted from the second boss portion in a radial direction,
on a back surface of the tray portion, a guide groove in an oval shape is formed so as to extend along the sheet discharging direction,
the link mechanism includes the convex portion and the guide groove, and the convex portion movably engages with the guide groove while restricting movement of the tray portion in a direction parallel to the sheet discharging direction, thereby allowing the tray portion to reciprocate in the sheet width direction.

5. The sorting device according to claim 4,
wherein
the output member has a light shielding portion formed in a part of an outer circumferential edge of the flange portion,
the base portion includes a detecting portion which detects the light shielding portion in a state in which the tray portion is disposed at a predetermined detecting position, and
the detecting portion detects that the tray portion is disposed at the predetermined sorting position based on whether or not the light shielding portion is being detected.

6. An image forming apparatus comprising:
an image forming portion which forms an image on a sheet;
a discharge portion which discharges the sheet on which an image is formed by the image forming portion in a sheet discharge space; and
the sorting device according to claim 1 which sorts the sheet discharged by the discharge portion.

* * * * *